US008806778B2

(12) United States Patent
Kishino

(10) Patent No.: US 8,806,778 B2
(45) Date of Patent: Aug. 19, 2014

(54) FOOTWEAR HAVING LACING SYSTEM CONNECTING FOOTWEAR AND INNER LINING

(71) Applicant: Etsuo Kishino, Niigata (JP)

(72) Inventor: Etsuo Kishino, Niigata (JP)

(73) Assignee: Kabushiki Kaisha Kurebu, Niigata (JP)

( * ) Notice: Subject to any disclaimer, the term of this patent is extended or adjusted under 35 U.S.C. 154(b) by 0 days.

(21) Appl. No.: 13/963,486

(22) Filed: Aug. 9, 2013

(65) Prior Publication Data

US 2013/0318820 A1 Dec. 5, 2013

Related U.S. Application Data

(62) Division of application No. 13/258,787, filed as application No. PCT/JP2010/059658 on Jun. 8, 2010.

(30) Foreign Application Priority Data

Jun. 17, 2009 (JP) ..... 2009-144567

(51) Int. Cl.
*A43C 11/00* (2006.01)

(52) U.S. Cl.
USPC ..... 36/50.1; 36/50.5

(58) Field of Classification Search
USPC ..... 36/50.1, 50.5, 52–56
See application file for complete search history.

(56) References Cited

U.S. PATENT DOCUMENTS 509,707 A * 11/1893 Vachon ..... 24/712.1
923,860 A * 6/1909 Kroell, M. ..... 36/54
3,169,325 A * 2/1965 Fesl ..... 36/117.1
3,703,775 A * 11/1972 Gatti ..... 36/128
3,834,048 A * 9/1974 Maurer ..... 36/50.1
4,630,383 A * 12/1986 Gamm ..... 36/136
4,937,952 A * 7/1990 Olivieri ..... 36/118.9
4,942,680 A * 7/1990 Benetti ..... 36/118.1
5,117,567 A * 6/1992 Berger ..... 36/50.1
5,269,078 A * 12/1993 Cochrane ..... 36/93
5,319,868 A * 6/1994 Hallenbeck ..... 36/50.1

(Continued)

FOREIGN PATENT DOCUMENTS

CA 2 514 770 A1 8/2005
CH 678 000 A5 7/1991

(Continued)

OTHER PUBLICATIONS

English Translation of International Preliminary Report on Patentability for PCT/JP2010/059658 dated Dec. 22, 2011.

(Continued)

*Primary Examiner* — Khoa Huynh
*Assistant Examiner* — Megan Brandon
(74) *Attorney, Agent, or Firm* — Sughrue Mion, PLLC

(57) ABSTRACT

The present invention provides footwear that is very easy to tighten. One end of a shoelace (6) is threaded between left to right sides in a staggered state through an instep opening (3A) to constitute tightening means (4) for the instep opening (3A), and the other end of the shoelace (6) is threaded between left to right sides in a staggered state through an upper opening (3B) to constitute tightening means (4) for the upper opening (3B). A medial portion of the shoelace (6) between the tightening means (4) for the instep opening (3A) and the upper opening (3B) forms a pull part (11), and tightened-state-holding means (12) is provided for holding the pull part (11) in a pulled state.

10 Claims, 6 Drawing Sheets

(56) References Cited

U.S. PATENT DOCUMENTS

| | | | | |
|---|---|---|---|---|
| 6,052,921 | A * | 4/2000 | Oreck | 36/50.1 |
| 6,240,657 | B1 * | 6/2001 | Weber et al. | 36/50.1 |
| 7,281,341 | B2 | 10/2007 | Reagan et al. | |
| 2001/0007178 | A1 * | 7/2001 | Pierre et al. | 36/50.5 |
| 2002/0002781 | A1 * | 1/2002 | Bouvier | 36/50.1 |
| 2002/0078597 | A1 * | 6/2002 | Burt | 36/51 |
| 2003/0034365 | A1 * | 2/2003 | Azam et al. | 223/113 |
| 2003/0226284 | A1 | 12/2003 | Grande et al. | |
| 2004/0074110 | A1 * | 4/2004 | Borsoi | 36/50.5 |
| 2004/0159017 | A1 | 8/2004 | Martin | |
| 2004/0205982 | A1 * | 10/2004 | Challe | 36/55 |
| 2004/0250388 | A1 | 12/2004 | Martin | |
| 2004/0250452 | A1 * | 12/2004 | Farys | 36/89 |
| 2005/0005477 | A1 | 1/2005 | Borsoi | |
| 2005/0126043 | A1 | 6/2005 | Reagan et al. | |
| 2005/0204585 | A1 * | 9/2005 | Loveridge et al. | 36/54 |
| 2006/0000116 | A1 * | 1/2006 | Brewer | 36/50.1 |
| 2006/0156584 | A1 * | 7/2006 | Johnson | 36/58.5 |
| 2006/0174516 | A1 | 8/2006 | Peruzzo | |
| 2006/0179685 | A1 | 8/2006 | Borel et al. | |
| 2006/0191164 | A1 | 8/2006 | Dinndorf et al. | |
| 2006/0196083 | A1 * | 9/2006 | Martin et al. | 36/50.5 |
| 2007/0068040 | A1 * | 3/2007 | Farys | 36/50.1 |
| 2008/0028641 | A1 | 2/2008 | Messmer | |
| 2008/0168685 | A1 * | 7/2008 | Kim et al. | 36/115 |

FOREIGN PATENT DOCUMENTS

| | | | |
|---|---|---|---|
| CN | 1794928 | A | 6/2006 |
| CN | 101631480 | A | 1/2010 |
| DE | 10 2007 002 367 | A1 | 7/2008 |
| EP | 0 370 949 | A1 | 5/1990 |
| FR | 2 802 782 | A1 | 6/2001 |
| JP | 02-182201 | A | 7/1990 |
| JP | 07-016105 | A | 1/1995 |
| JP | 2003-518397 | A | 6/2003 |
| JP | 2004-041666 | A | 2/2004 |
| JP | 3115773 | U | 11/2005 |
| JP | 2006-517450 | A | 7/2006 |
| JP | 2007-500835 | A | 1/2007 |
| JP | 2007-215845 | A | 8/2007 |
| JP | 2008-194223 | A | 8/2008 |
| JP | 2009-089902 | A | 4/2009 |
| JP | 4616920 | B2 | 1/2011 |
| JP | 4741711 | B2 | 8/2011 |
| WO | 01/47386 | A1 | 7/2001 |
| WO | 2004/071227 | A1 | 8/2004 |
| WO | 2005/003591 | A1 | 1/2005 |
| WO | 2008/086883 | A1 | 7/2008 |

OTHER PUBLICATIONS

International Search Report for PCT/JP2010/059658 dated Jul. 13, 2010.

* cited by examiner

FOOTWEAR HAVING LACING SYSTEM CONNECTING FOOTWEAR AND INNER LINING

CROSS REFERENCE TO RELATED APPLICATIONS

This application is a divisional of U.S. application Ser. No. 13/258,787, filed Sep. 22, 2011, which is a National Stage of International Application No. PCT/JP2010/059658, filed on Jun. 8, 2010, which claims priority from Japanese Patent Application No. 2009-144567, filed Jun. 17, 2009, the contents of all of which are incorporated herein by reference in their entirety.

TECHNICAL FIELD

The present invention relates to footwear that is easy to tighten and provides a comfortable fit.

BACKGROUND ART

A conventional configuration for tightening footwear is the configuration of using shoelaces to tighten the footwear from an instep part covering an instep to an ankle opening. This configuration for tightening using shoelaces is often employed, for example, in footwear designed to have an upper covering part higher than the ankle, such as snowboarding boots.

This configuration for tightening using shoelaces, however, requires great strength to tighten the laces sequentially from the toes, and considerable time to tighten up the laces from the toes to the shin in footwear having an upper covering part reaching the shin, such as snowboarding boots. Tightening up the shin portion also loosens the toe portion, making it difficult to tighten the footwear tightly.

Therefore, a conventional snowboarding boot has been proposed in which an instep part and a shin portion can be adjusted separately to prevent loosening by disposing separate tightening configurations using shoelaces for the instep part and the shin portion of the boot, and disposing lace restraining means on each shoelace enables the lace restraining means to be used to readily prevent loosening of the shoelaces (Patent Document 1).

The present applicant also invented and applied for Japanese Laid-open Patent Publications Nos. 2008-194223 (Patent Document 2) and 2009-89902 (Patent Document 3), whereby troublesome tightening can be performed readily and quickly.

BACKGROUND ART DOCUMENTS

Patent Documents

Patent Document 1: Japanese Registered Utility Model Publication No. 3115773

Patent Document 2: Japanese Laid-open Patent Publication No. 2008-194223

Patent Document 3: Japanese Laid-open Patent Publication No. 2009-89902

DISCLOSURE OF THE INVENTION

Problems that the Invention is Intended to Solve

After having developed the inventions in the above Patent Documents 2 and 3, the present applicant continued extensive research by trial and error to find footwear that is even easier to tighten and more comfortable to the feet, and ultimately perfected the present invention.

Means of Solving the Problems

The main points of the present invention are described below with reference to the attached drawings.

The present invention according to a first aspect relates to a footwear provided with an upper covering part 1 higher than an ankle portion and a front opening 3 that opens from the upper covering part 1 to an instep part 2, and having separate tightening means 4 for each of an instep opening 3A and an upper opening 3B of the front opening 3; wherein the footwear is characterized in that one end 6'(i.e., a first end) of a shoelace 6 comprising a single lace or a plurality of connected laces is threaded between left to right sides in a staggered state through the instep opening 3A to constitute the tightening means 4 for the instep opening 3A; another end 6" (i.e., a second end) of the shoelace is threaded between left to right sides in a staggered state through the upper opening 3B to constitute the tightening means 4 for the upper opening 3B; a medial portion 6'" of the shoelace 6, the medial portion 6'" being present between the tightening means 4 for the instep opening 3A and the tightening means 4 for the upper opening 3B, is configured to be pulled at a pull portion 6P of the medial portion 6'", adapted to serve as a pull part 11; pulling the pull part 11 enables one or both of the tightening means 4 for the instep opening 3A and the tightening means 4 for the upper opening 3B to be tightened; and holding- and releasing-enabled tightened-state-holding means 12 is provided for holding the pull part 11 in a pulled state and holding either one or both of the instep opening 3A and the upper opening 3B in a tightened state; a tongue member 17 is arranged in the front opening 3; a part of the medial portion 6'" of the shoelace 6 is arranged in the front of the tongue member 17 and threaded between the surface part of the tongue member 17 and the shoelace 6 of the tightening means 4 for the upper opening 3B, whereby the medial portion 6'" of the shoelace 6 and the shoelace 6 of the tightening means 4 for the upper opening 3B directly intersect and overlap; a shoelace guide part 18 for upwardly guiding the medial portion of the shoelace 6 threaded through to the front of the tongue member 17 is provided above the tongue member 17; and the tightened-state-holding means 12 is provided on the medial portion of the shoelace 6 guided upward via the shoelace guide part 18.

The present invention according to a second aspect relates to footwear comprising a footwear body A and an inner body B inserted into the footwear body A, the footwear body A having an upper covering part 1 higher than an ankle portion and having a front opening 3 that opens from the upper covering part 1 to an instep part 2, the footwear body A provided with separate tightening means 4 for each of an instep opening 3A and an upper opening 3B of the front opening 3; and the inner body B having an upper covering part 13 higher than an ankle portion and a front opening 14 in at least the upper covering part 13; wherein the footwear is characterized in that an inner lining eyelet 15 is provided respectively on left and right edges of the front opening 14 of the inner body B, one end 6' of a shoelace 6 made of a single lace or a plurality of connected laces is threaded through one inner lining eyelet 15 and the one end 6' of the shoelace 6 is threaded between left to right sides in a staggered state through the instep opening 3A of the footwear body A to constitute the tightening means 4 for the instep opening 3A; another end 6" of the shoelace 6 is threaded through another inner lining eyelet 15 and the another end 6" of the shoelace 6 is threaded between left to right sides in a staggered state through the upper opening 3B of the footwear body A to constitute the tightening means 4 for the upper opening 3B; a medial portion 6''' of the shoelace 6, the medial portion being present between the one inner lining eyelet 15 and the other inner lining eyelet 15, is adapted to serve as a pull part 11; pulling the pull part 11 tightens the front opening 14 of the inner body B, and enables either one or both of the tightening means 4 for the instep opening 3A and the tightening means 4 for the upper opening 3B of the footwear body A to be tightened; and the footwear comprises holding- and releasing-enabled tightened-state-holding means 12 for holding the pull part 11 in a pulled state, holding the front opening 14 of the inner body B in a tightened state, and holding either one or both of the instep opening 3A and the upper opening 3B of the footwear body A in a tightened state.

The present invention according to a third aspect relates to the footwear according to either the first or second aspect, and is characterized in that, in the tightening means 4, a lace-anchoring part 5 is provided on one of either the left or right edge of the instep opening 3A and the upper opening 3B, and the one end 6' and the another end 6'' of the shoelace 6 are anchored to the lace-anchoring part 5; a first lace support part 7 for supporting and causing a doubling-back of the medial portion 6''' of the shoelace 6 anchored to the lace-anchoring part 5 is provided on the another of either the left or right edge of the instep opening 3A and the upper opening 3B; a second lace support part 8 for supporting the medial portion 6''' of the shoelace 6 supported and caused to double back by the first lace support part 7 so that the medial portion 6''' of the shoelace does not cross a part of the shoelace present between the lace-anchoring part 5 and the first lace support part 7, the second lace support part provided on the one of either the left or right edge of the instep opening 3A and the upper opening 3B; and pulling the medial portion 6''' of the shoelace 6 supported by the second lace support part 8 enables the instep opening 3A and the upper opening 3B to be tightened.

The present invention according to a fourth aspect relates to the footwear according to third aspect, and is characterized in that the lace-anchoring part 5 and the first lace support part 7 are provided substantially horizontal and opposite to either one or the another of the left or right edge of the instep opening 3A and the upper opening 3B; the second lace support part 8 is provided in a higher or lower position than the lace-anchoring parts 5 in either one of the left or right edge of the instep opening 3A and the upper opening 3B; and the medial portion of the shoelace 6 supported and caused to double back by each of the first lace support parts 7 is supported by the second lace support part 8 so as not to cross the portion of the shoelace 6 present between each of the lace-anchoring parts 5 and first lace support parts 7.

The present invention according to a fifth aspect relates to the footwear according to the third aspect, characterized in that a pulley 16 is employed for the first lace support part 7 and the second lace support part 8.

The present invention according to a sixth aspect relates to the footwear according to the fourth aspect, and is characterized in that a pulley 16 is employed for the first lace support part 7 and the second lace support part 8.

The present invention according to a seventh aspect relates to the footwear according to the third aspect, and is characterized in that the second lace support part 8 for supporting and causing a doubling-back of the medial portion of the shoelace 6 supported and caused to double back by the first lace support part 7 is provided on one of either the left or right edge of the instep opening 3A and the upper opening 3B; a third lace support part 9 for supporting the medial portion of the shoelace 6 supported and caused to double back by the second lace support part 8, the medial portion of the shoelace 6 supported so as not to cross the portion of the shoelace 6 present between each of the first lace support parts 7 and the second lace support parts 8, is provided on the another of either the left or right edge of the instep opening 3A and the upper opening 3B; and tightening means 4 is constituted so that by pulling the medial portion of the shoelace 6 supported by the third lace support parts 9, the instep opening 3A and the upper opening 3B can be tightened.

The present invention according to an eighth aspect relates to the footwear according to the fourth aspect, and is characterized in that the second lace support part 8 for supporting and causing a doubling-back of the medial portion of the shoelace 6 supported and caused to double back by the first lace support part 7 is provided on one of either the left or right edge of the instep opening 3A and the upper opening 3B; a third lace support part 9 for supporting the medial portion of the shoelace 6 supported and caused to double back by the second lace support part 8, the medial portion of the shoelace 6 supported so as not to cross the portion of the shoelace 6 present between each of the first lace support parts 7 and the second lace support parts 8, is provided on the another of either the left or right edge of the instep opening 3A and the upper opening 3B; and tightening means 4 is constituted so that by pulling the medial portion of the shoelace 6 supported by the third lace support parts 9, the instep opening 3A and the upper opening 3B can be tightened.

The present invention according to a ninth aspect relates to the footwear according to the fifth aspect, and is characterized in that the second lace support part 8 for supporting and causing a doubling-back of the medial portion of the shoelace 6 supported and caused to double back by the first lace support part 7 is provided on one of either the left or right edge of the instep opening 3A and the upper opening 3B; a third lace support part 9 for supporting the medial portion of the shoelace 6 supported and caused to double back by the second lace support part 8, the medial portion of the shoelace 6 supported so as not to cross the portion of the shoelace 6 present between each of the first lace support parts 7 and the second lace support parts 8, is provided on the another of either the left or right edge of the instep opening 3A and the upper opening 3B; and tightening means 4 is constituted so that by pulling the medial portion of the shoelace 6 supported by the third lace support parts 9, the instep opening 3A and the upper opening 3B can be tightened.

The present invention according to a tenth aspect relates to the footwear according to the sixth aspect, and is characterized in that the second lace support part 8 for supporting and causing a doubling-back of the medial portion of the shoelace 6 supported and caused to double back by the first lace support part 7 is provided on one of either the left or right edge of the instep opening 3A and the upper opening 3B; a third lace support part 9 for supporting the medial portion of the shoelace 6 supported and caused to double back by the second lace support part 8, the medial portion of the shoelace 6 supported so as not to cross the portion of the shoelace 6 present between each of the first lace support parts 7 and the second lace support parts 8, is provided on the another of either the left or right edge of the instep opening 3A and the upper opening 3B; and tightening means 4 is constituted so that by pulling the medial portion of the shoelace 6 supported by the third lace support parts 9, the instep opening 3A and the upper opening 3B can be tightened.

The present invention according to an eleventh aspect relates to the footwear according to the second aspect, and is characterized in that a tongue member 17 is arranged in the front opening 3; the medial portion of the shoelace 6 is threaded through the tongue member 17 from front to back; a shoelace guide part 18 for upwardly guiding the medial portion of the shoelace 6 threaded through to the back is provided above the tongue member 17; and the tightened-state-holding means 12 is provided on the medial portion of the shoelace 6 guided upward via the shoelace guide part 18.

The present invention according to a twelfth aspect relates to the footwear according to either the first or second aspect, and is characterized in that there is used in the tightened-state-holding means 12 a lace fastener 21 in which a pressable or releaseable press-contact piece 20 for making contact under pressure with a shoelace 6 inserted through a insertion portion through which the shoelace 6 is inserted is provided on a lace fastener body 19 provided with the insertion portion.

Effects of the Invention

According to the first aspect of the invention configured as described above, there is provided innovative footwear having very good practical utility, in which one action of merely pulling a pull part can simultaneously tighten the tightening means for an instep part (instep opening) and the tightening means for an upper covering part (upper opening) to fit a foot, can facilitate adjustments such as tightening only the instep opening or just the upper opening, and can increase the ease of operation because the operation for pulling this pull part may be performed by both hands or one hand alone. The tightened-state-holding means can also hold the comfortable fit obtained by this simple tightening operation.

Furthermore, according to the first aspect of the present invention, it is possible to perform the operation of tightening or releasing the tightened-state-holding means and the operation of pulling the pull part from above the tongue member. This enables the user to readily perform these operations from a more comfortable stance, giving the footwear an even higher degree of utility.

According to the second aspect of the invention configured as described above, there is provided innovative footwear having very good practical utility in which, besides the operation and effects described above, one action of merely pulling the pull part can simultaneously tighten the front opening of an inner body and either one or both of the tightening means for an instep opening and the tightening means for an upper opening of a footwear body.

The third aspect of the invention provides footwear which is configured with even greater practical utility and can be completely tightened by a simple and quick operation for pulling the pull part. This is because there are few locations where the shoelaces are supported by the tightening means; therefore, less frictional resistance is encountered by the shoelaces, and frictional resistance by the shoelace itself is eliminated by having each of the shoelaces supported so as not to cross midway.

The invention according to the fourth aspect provides footwear that is configured with even greater practical utility and can achieve a simple design of the tightening means for supporting the shoelaces without crossing.

The invention according to the fifth and sixth aspects provides footwear that is configured to have very good practical utility and an even simpler and quicker operation for pulling the pull part (tightening operation performed by the tightening means) by reducing pulling resistance on the shoelaces even more.

The invention according to the seventh to tenth aspects provides footwear having very good practical utility, in which adopting a configuration to support shoelaces with a first lace support part, a second lace support part, and a third lace support part causes a range wider than the instep opening and the upper opening to be tightened by the laces, to provide an even more comfortable fit.

The invention according to the eleventh aspect provides footwear that has even greater ease of operation and practical utility, such as securely reducing the pulling resistance of the pull part, because passing the medial portion of a shoelace through a tongue member from front to back and guiding upward the medial portion of the shoelace threaded through to the back by a shoelace guide part ensures that the medial portion of the shoelace does not cross the portion of the shoelace comprising the tightening means; and allows the user to readily carry out the operation in a more comfortable posture because the user can pull the pull part and tighten or release the tightened-state-holding means above the tongue member.

The invention according to the twelfth aspect provides footwear that is configured to have even greater practical utility and achieve a simple design for tightened-state-holding means having good ease of operation.

BEST MODE FOR CARRYING OUT THE INVENTION

Figure 1:
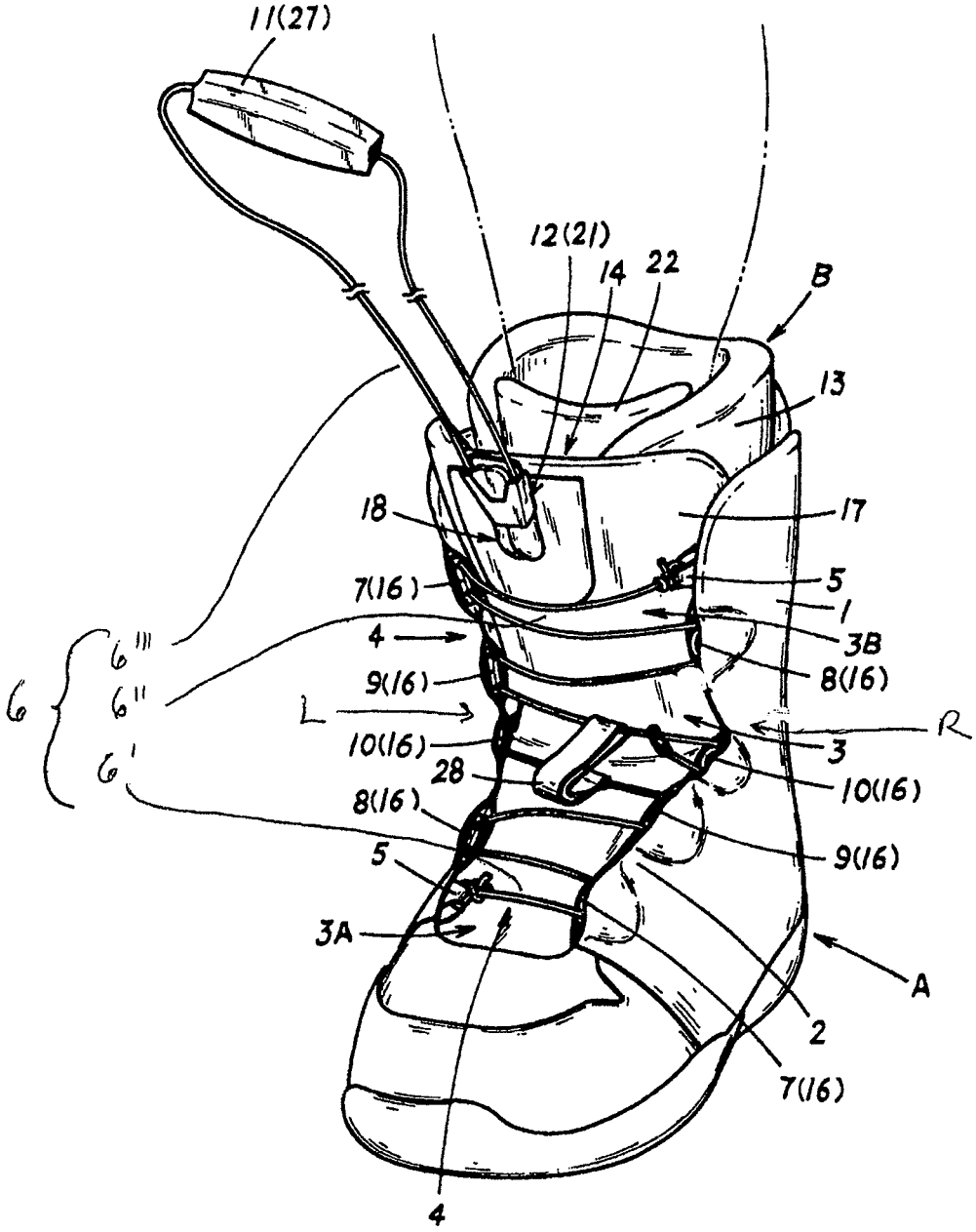
FIG. 1 is a perspective view showing the footwear of Example 1 with the shoelaces tightened.

Preferred embodiments of the present invention (showing how the present invention is implemented) are briefly described below, and the effects of the present invention indicated, with reference to the drawings.

In the case of the invention of the first aspect, placing a foot in the article of the present invention and pulling a pull part 11 of the medial portion 6''' of a shoelace 6 by tightening, simultaneously, tightening means 4 for an instep opening 3A in a front opening 3 wherein one end (a first end) 6' of the shoelace 6 is threaded left to right in a staggered state, and tightening means 4 for an upper opening 3B in the front opening 3 wherein the another end (a second end) 6'' of the shoelace 6 is threaded left to right in a staggered state.

Operating the pull part 11 so as to pull just one end 6' of the shoelace 6 can tighten just the tightening means 4 for the instep opening 3A, and operating the pull part 11 so as to pull just the other end 6'' of the shoelace 6 can tighten just the tightening means 4 for the upper opening 3B.

Therefore, the single action of merely pulling the pull part 11 can simultaneously tighten the instep part 2 (the instep opening 3A) and the upper covering part 1 (the upper opening 3B) to readily fit the article of the present invention to the foot, and merely changing the manner in which the pull part 11 is pulled readily enables fine adjustments to be made wherein merely the instep opening 3A or merely the upper opening 3B is tightened. This operation for pulling the pull part 11 may be performed by both hands or one hand alone, which provides good ease of operation and greatly facilitates the tightening operation.

Holding the pulling member 11 in a pulled state using the tightened-state-holding means 12 after the tightening operation has concluded holds either one or both of the instep opening 3A and the upper opening 3B in a tightened state to hold the comfortable fit to the foot.

In the case of the invention of the second aspect, placing a foot in an inner body B fitted inside a footwear body A and pulling a pull part 11 of the medial portion 6''' of a shoelace 6 simultaneously tightens the tightening means 4 for an instep opening 3A in a front opening 3 of the footwear body A wherein one end 6' of the shoelace 6 is threaded left to right in a staggered state, and tightening means 4 for an upper opening 3B in the front opening 3 wherein the another end 6'' of the shoelace 6 is threaded left to right in a staggered state. At this time, one end 6' of the shoelace 6 is threaded through one of two inner lining eyelets 15 provided on the left and right sides of a front opening 14 in the inner body B, and the other end 6'' of the shoelace 6 is threaded through the other inner lining eyelet 15, thereby simultaneously tightening the front opening 14 of the inner body B.

Operating the pull part 11 so as to pull merely one end 6' of the shoelace 6 can tighten merely the tightening means 4 for the instep opening 3A, and operating the pull part 11 so as to pull merely the other end 6'' of the shoelace 6 can tighten merely the tightening means 4 for the upper opening 3B.

Therefore, the single action of merely pulling the pull part 11 can simultaneously tighten an instep part 2 (the instep opening 3A) and an upper covering part 1 (the upper opening 3B) of the footwear body A, and at the same time, tighten at least the upper covering part 13 (the front opening 14) of the inner body B to fit the article of the present invention to a foot. Merely changing the manner in which the pull part 11 is pulled readily enables fine adjustments to be made wherein merely the instep opening 3A or merely the upper opening 3B is tightened. The operation for pulling the pull part 11 may be performed by both hands or one hand alone, which provides good ease of operation and greatly facilitates the tightening operation.

Holding the pulling member 11 in a pulled state using the tightened-state-holding means 12 after completing the tightening operation holds the front opening 14 of the inner body B and either one or both of the instep opening 3A and the upper opening 3B of the footwear body A in a tightened state to hold the comfortable fit to the foot.

In a case where, in the tightening means 4, a lace-anchoring part 5 is provided on one of either the left or right edge L, R of the instep opening 3A and the upper opening 3B, and the one end 6' and the another end 6'' of the shoelace 6 are anchored to the lace-anchoring part 5; a first lace support part 7 for supporting and causing a doubling-back of the medial portion 6''' of the shoelace 6 anchored to the lace-anchoring part 5 is provided on the another of either the left or right edge L, R of the instep opening 3A and the upper opening 3B; a second lace support part 8 for supporting the medial portion 6''' of the shoelace 6 supported and caused to double back by the first lace support part 7 so that the medial portion 6''' of the shoelace does not cross a part of the shoelace 6 present between the lace-anchoring part 5 and the first lace support part 7, the second lace support part provided on the one of either the left or right edge L, R of the instep opening 3A and the upper opening 3B; and pulling the medial portion 6''' of the shoelace 6 supported by the second lace support part 8 enables the instep opening 3A and the upper opening 3B to be tightened, arranging the one end 6' and the another end 6' of the shoelace 6 left to right in a staggered state in a predetermined range of the instep opening 3A and the upper opening 3B, the predetermined range of the instep opening 3A and the upper opening 3B where the shoelace 6 is located can be suitably tightened.

The shoelace 6 supported by the first lace support part 7 and the second lace support part 8 is subject to less frictional resistance from the first lace support part 7 and the second lace support part 8 because the shoelace is supported in few locations, while frictional resistance by the shoelace 6 itself is eliminated because both tightening means 4 support and cause the medial portions of both shoelaces 6 to double back via the first lace support parts 7 provided on the other of either the left or right edge L, R of the instep opening 3A and the upper opening 3B, then support these shoelaces on the second lace support parts 8 provided on the first of either the left or right edge L, R of the instep opening 3A and the upper opening 3B, so as not to cross the portions of the shoelaces 6 between the lace-anchoring parts 5 and the first lace support parts 7.

Therefore, the operation for pulling the medial portion 6''' of the shoelaces 6 (using the pull part 11) produces little resistance, and can complete the tightening operation by a simple and quick pulling operation.

Since the operation for pulling the pull part 11 is thus greatly facilitated, there can be provided highly practical footwear in which the instep part 2 and the upper covering part 1 can be quickly tightened and held in a tightened state.

Example 1

A specific Example 1 of the present invention is described below with reference to FIGS. 1 to 6.

This example shows an application of the present invention to footwear (boots) for snowboarding.

Described simply, the snowboarding boots comprise a footwear body A forming an outer boot A, and an inner body B forming an inner boot B fitted inside and freely detachable from the footwear body A.

The footwear body A is provided with an upper covering part 1 covering above the ankle to midway on the shin, a front opening 3 open from the front of the ankle opening of this upper covering part 1 to the instep part 2, and a tongue member 17 arranged in the front opening 3.

The inner body B is provided with an upper covering part 13 covering above the ankle to midway on the shin, a front opening 14 open from in front of the ankle opening of the upper covering part 13 to the ankle, and a tongue member 22 arranged in the front opening 14.

In the present example, separate tightening means 4 is provided respectively for the instep opening 3A and the upper opening 3B of the front opening 3 in the footwear body A.

Specifically, one end 6' of a shoelace 6 comprising a single long lace is threaded between left to right sides in a staggered state through the instep opening 3A to constitute the tightening means 4 for the instep opening 3A, and the other end 6'' of the shoelace 6 is threaded between left to right sides in a staggered state through the upper opening 3B to constitute the tightening means 4 for the upper opening 3B.

First, the tightening means 4 for the instep opening 3A will be described.

A lace-anchoring part 5 is provided on one of either the left or right edge L, R (the left-side edge L in the drawing) on the toe side of the instep opening 3A to secure one end 6' of the shoelace 6 to this lace-anchoring part 5.

More specifically, a annular part through which the shoelace 6 can pass projects from one edge on the toe side of the instep opening 3A toward the inside (oriented to the other edge) of the instep opening 3A, and this annular part forms the lace-anchoring part 5. In the example shown, one end 6' of the shoelace 6 has been anchored by being tied to the lace-anchoring part 5.

A first lace support part 7 is provided on the other edge on the toe side of the instep opening 3A (the right-side edge in the drawing) to support and cause the other end of the shoelace 6 (towards the medial part), one end of which has been anchored by the lace-anchoring part 5, to double back toward the first edge of the instep opening 3A. A second lace support part 8 is provided on the first edge of the instep opening 3A to support and cause the other end (towards the medial part) of the shoelace 6 caused to double back by the first lace support part 7 to double back toward the other edge of the instep opening 3A. A third lace support part 9 is provided on the other edge of the instep opening 3A to support and cause the other edge (towards the medial part) of the shoelace 6 caused to double back by the second lace support part 8 to double back toward the first edge of the instep opening 3A. A fourth lace support 10 is provided on the first edge of the instep opening 3A to support and cause the other end (towards the medial part) of the shoelace 6 caused to double back by the third lace support part 9 to double back toward the other edge of the instep opening 3A.

Figure 7:
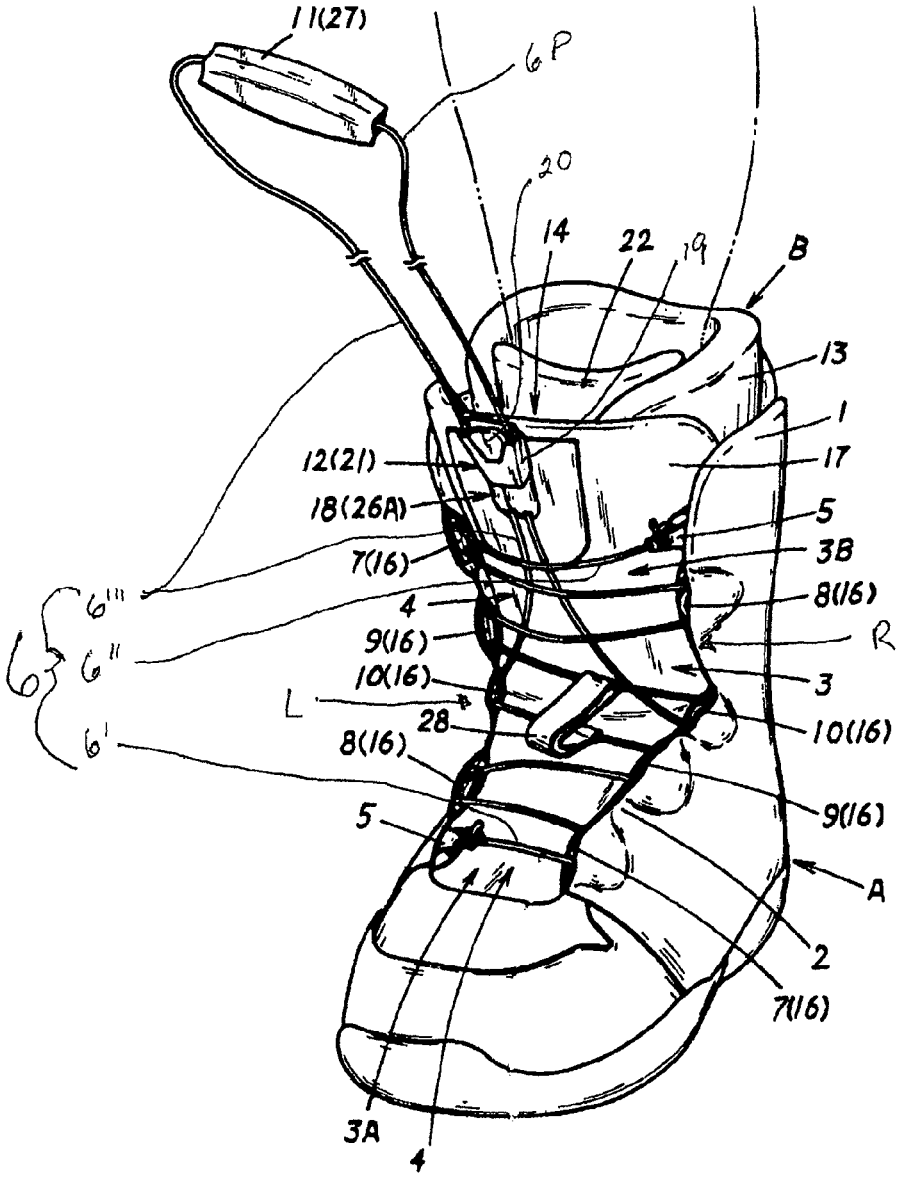
FIG. 7 is a perspective view showing Example 2.

As shown in FIGS. 1 and 7, the instep opening 3A includes four lace support parts and a lace anchoring part, and the upper opening 3B includes four lace support parts and a lace anchoring part.

More specifically, each of the first lace support part 7, the second lace support part 8, the third lace support part 9, and fourth lace support 10 comprises a pulley 16.

Figure 4:
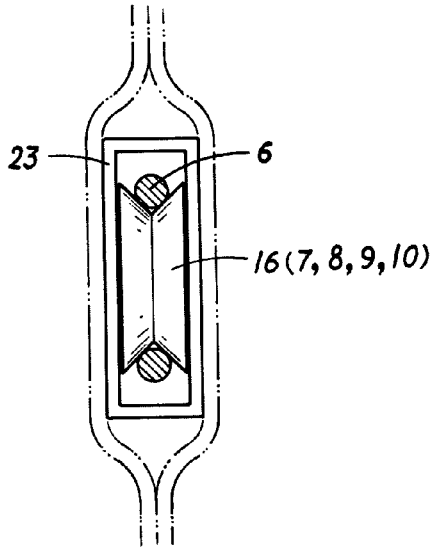
FIG. 4 is a partially enlarged descriptive drawing showing a configuration for attaching pulleys (first lace support part, second lace support part, third lace support part, and fourth lace support) in Example 1.
Figure 5:
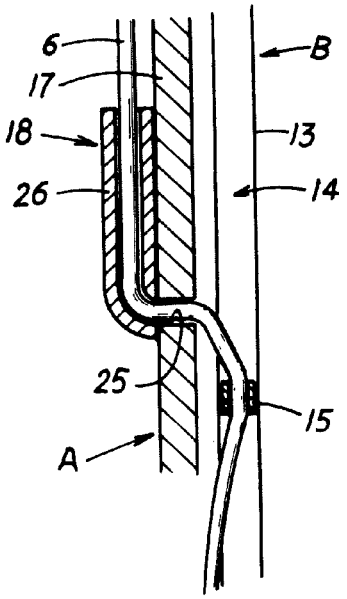
FIG. 5 is a partially enlarged descriptive drawing showing a shoelace guide part of Example 1.

As shown in FIG. 4, the structure for attaching each of these pulleys 16 to the footwear body A is a structure in which a frame-shaped bearing 23 for supporting the pulley 16, is held fast between the two sides of a two-sided casing.

The pulley 16 forming the first lace support part 7 is provided substantially horizontally opposite the lace-anchoring part 5, the pulley 16 forming the second lace support part 8 is provided in a position somewhat closer to the ankle than the first lace support part 7, the pulley 16 forming the third lace support part 9 is provided in a position somewhat closer to the ankle than the second lace support part 8, and the pulley 16 forming the fourth lace support 10 is provided in a position somewhat closer to the ankle than the third lace support part 9.

The other end of the shoelace 6 (towards the medial part), one end of which being anchored to the lace-anchoring part 5, is supported by being wrapped substantially semicircularly around the first lace support part 7, the second lace support part 8, and the third lace support part 9 in the stated order and from below the pulleys 16, whereby the lace supports 7, 8, and 9 cause the other end of the shoelace 6 (towards the medial part) to double back toward the opposite edge of the instep opening 3A; and support the portion of the shoelace 6 located between the lace-anchoring part 5 and the first lace support part 7, the portion of the shoelace 6 located between the first lace support part 7 and the second lace support part 8, and the portion of the shoelace 6 located between the second lace support part 8 and the third lace support part 9 from left to right in a staggered state without crossing each other.

The other end (towards the medial part) of the shoelace 6 supported and caused to double back on the third lace support part 9 is then wrapped around from below and supported by the fourth lace support 10, so that pulling the other end of the shoelace 6 (towards the medial part) supported by the fourth lace support 10 can tighten the instep opening 3A. Although the drawings show the shoelace 6 supported on all of the lace supports 7, 8, 9, 10 comprising pulleys 16 by wrapping around from below, the shoelace may be supported by wrapping around from above depending on the arrangement, the number, and other factors relating to the lace supports 7, 8, 9, 10.

In the present example, all of the first lace support part 7, the second lace support part 8, the third lace support part 9, and the fourth lace support 10 are concealed so as to not be exposed outside the casing of the footwear body A and to reduce the likelihood of causing an obstruction.

Next, the tightening means 4 for the upper opening 3B will be described.

Specifically, the same configuration as the tightening means 4 for the instep opening 3A is employed, but the lace-anchoring part 5, the first lace support part 7, the second lace support part 8, the third lace support part 9, and the fourth lace support 10 are provided in reverse order vertically and horizontally to the corresponding parts of the tightening means 4 for the instep opening 3A.

That is, which of the left and right edges L, R is the one edge and which is the other edge in this upper opening 3B are reversed from the instep opening 3A, and the first lace support part 7, the second lace support part 8, the third lace support part 9, and the fourth lace support 10 are provided in the upper opening 3B in the stated order starting from the top.

More specifically, the lace-anchoring part 5 is provided on one edge (the right-side edge in the drawing) on the upper side (toward the ankle opening) of the upper opening 3B, the first lace support part 7 is provided on the other edge of the upper opening 3B (the left-side edge in the drawing) substantially horizontally opposite the lace-anchoring part 5, the second lace support part 8 is provided on the first edge of the upper opening 3B so as to be positioned somewhat closer to the ankle than the first lace support part 7, the third lace support part 9 is provided on the other edge of the upper opening 3B so as to be positioned somewhat closer to the ankle than the second lace support part 8, the fourth lace support 10 is provided on the first edge of the upper opening 3B so as to be positioned somewhat closer to the ankle than the third lace support part 9, the other end of the shoelace 6 is anchored to the lace-anchoring part 5, and the first end of the shoelace 6 (towards the medial part) is wrapped around from above, and supported by, the lace supports 7, 8, 9, 10 in the stated order.

In the present example, the fourth lace support 10 of the tightening means 4 for the instep opening 3A and the fourth lace support 10 of the tightening means 4 for the upper opening 3B are provided substantially horizontally opposite the ankle position of the footwear body A. As a result, the tightening means 4 for the instep opening 3A tightens substantially the full range of the instep opening 3A, and the tightening means 4 for the upper opening 3B tightens substantially the full range of the upper opening 3B to comfortably fit the foot.

Therefore, since the tightening means 4 for the present example are configured to support the shoelaces 6 in merely the four locations of the lace supports 7, 8, 9, 10, the shoelaces are subjected to less frictional resistance from the lace supports 7, 8, 9, 10 due to the small number of supporting locations. Moreover, since the shoelace 6 does not cross itself, frictional resistance by the shoelace 6 itself is eliminated, and pulling the shoelaces can readily tighten the footwear with very little force because the lace supports 7, 8, 9, constitute the pulleys 16.

In the present example, through-holes 24 are formed in the left and right of the ankle portion of the tongue member 17 going through this tongue member 17 from back to front, the other end (towards the medial part) of the shoelace 6 in the tightening means 4 for the instep opening 3A is threaded through the tongue member 17 from front to back through one of the through-holes 24 (the left through-hole in the drawing), and the first end of the shoelace 6 (towards the medial part) in the tightening means 4 for the upper opening 3B is threaded through the tongue member 17 from back to front through the other through-hole 24 (the right through-hole in the drawing) to arrange the medial portion 6''' of a single shoelace 6 positioned between the two tightening means 4 behind the tongue member 17.

An inner lining eyelet 15, through which the shoelace 6 can be passed, is provided on one of either the left or right edge L, R of the front opening 14 of the inner body B.

Specifically, annular parts through which the shoelace 6 can pass in a vertical direction are provided in symmetrical locations on both edges L, R of the front opening 14, and these annular parts form inner lining eyelets 15.

Figure 2:
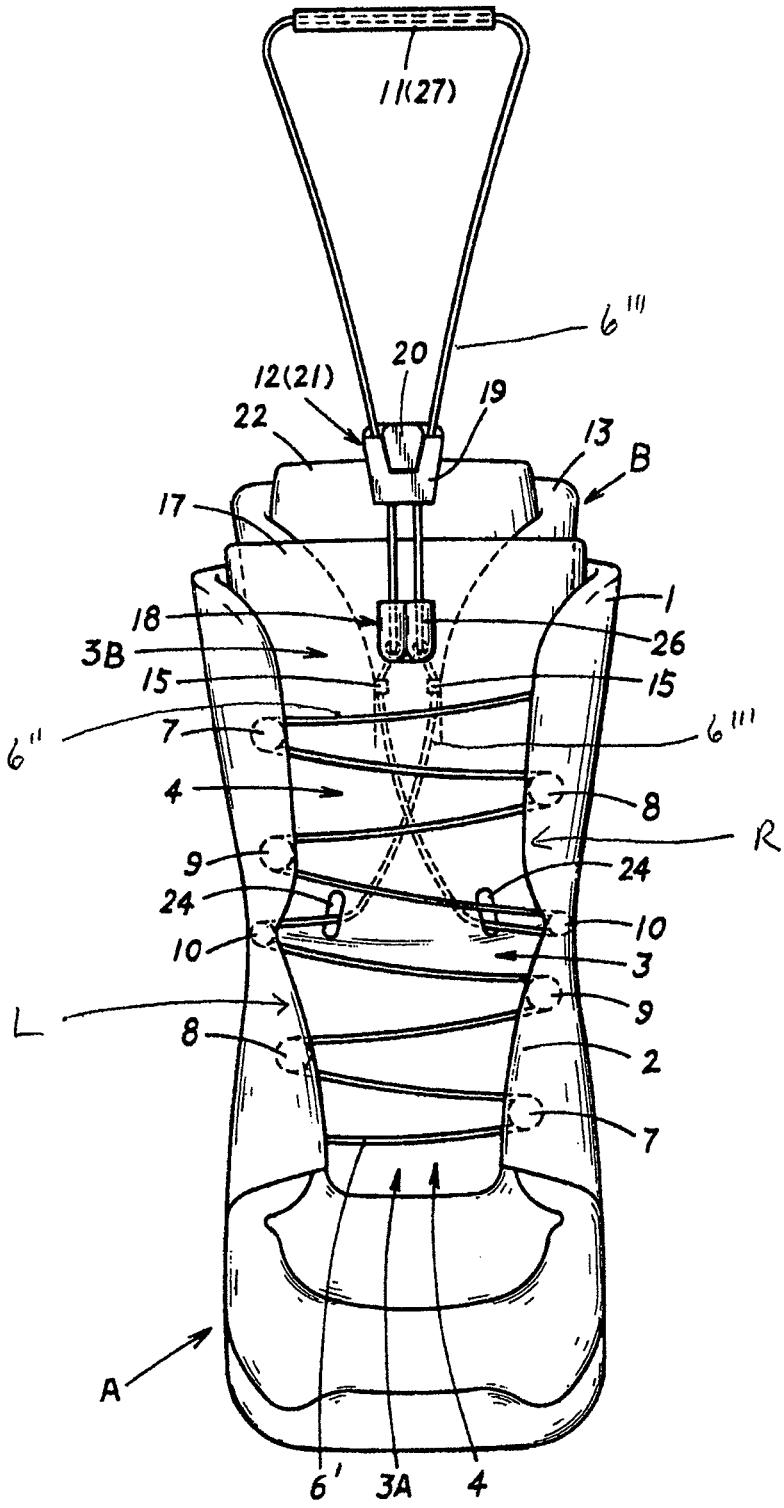
FIG. 2 is a schematic front elevation view showing the footwear of Example 1 with the shoelaces loosened.
Figure 3:
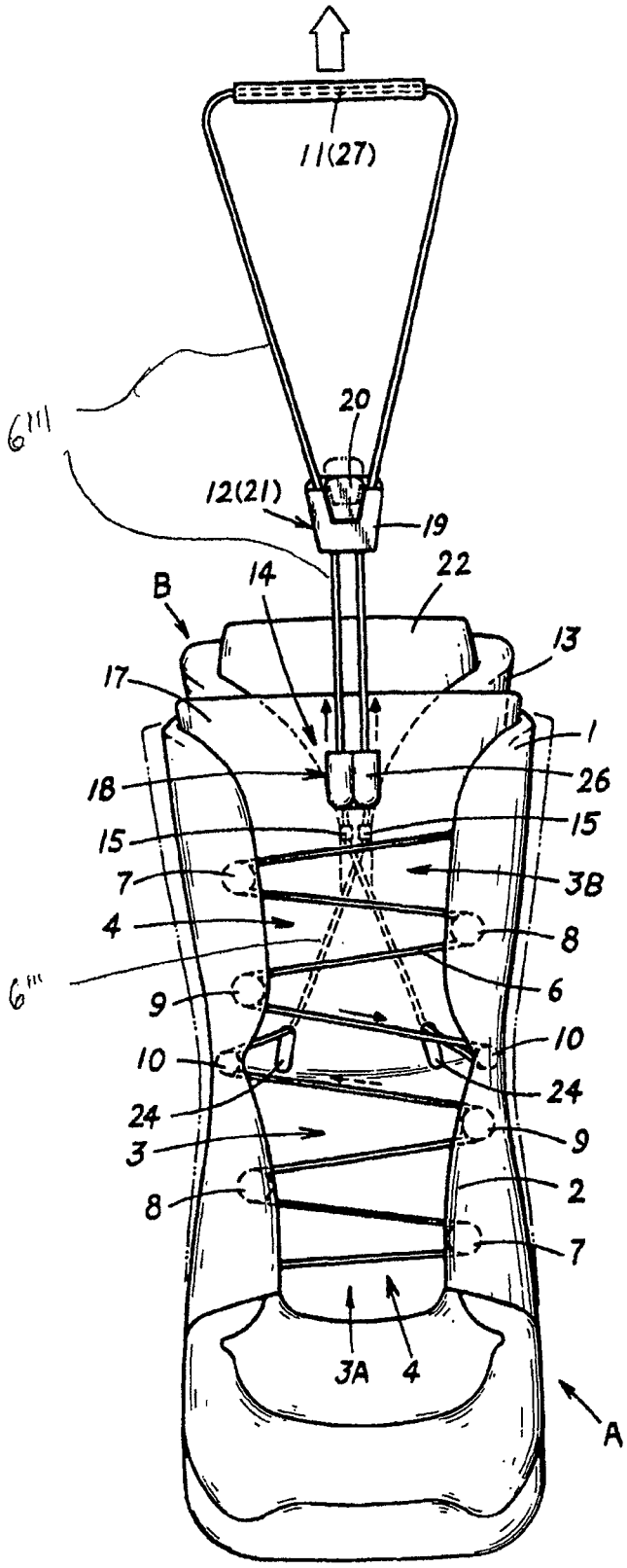
FIG. 3 is a schematic front elevation view showing the footwear of Example 1 with the shoelaces tightened.

As shown in FIGS. 2 and 3, after the two side portions of the medial portion of the shoelace 6 threaded through in back of the tongue member 17 cross each other, they pass through the left and right inner lining eyelets 15 from below to above. More specifically, the side of the medial portion of the shoelace 6 relative to the tightening means 4 for the upper opening 3B (the other end of the shoelace 6) passes through one inner lining eyelet 15 (on the left-side edge in the drawing), and the side of the medial portion of the shoelace relative to the tightening means 4 for the instep opening 3A (the first end of the shoelace 6) passes through the other inner lining eyelet 15 (on the right-side edge in the drawing).

In the present example, a shoelace guide part 18 is provided in the upper portion of the tongue member 17 to guide the medial portion 6''' of the shoelace 6 threaded through in back of the tongue member 17 upward in a converged state in back of the tongue member 17.

Specifically, the shoelace guide part 18 comprises through-holes 25 provided in an upper central portion of the tongue member 17 so as to go through the tongue member 17 from front to back while parallel and adjacent to each other left and right, and a double pipe 26 joining two parallel pipe members attached in an upper central portion of the front face of the tongue member 17 in communication with the through-hole 25. The medial portions of the shoelaces 6 passing through the inner lining eyelets 15 pass from the through-holes 25 of the shoelace guide part 18 into the double pipe 26 to pass through the tongue member 17 again from back to front and project upward from the upper end of the double pipe 26.

In the present example, a gripping member 27 covers and is anchored to the medial portion 6''' of the shoelace 6 protruding upward through the shoelace guide part 18, and the gripping member 27 functions as a grippable pull part 11.

Pulling the pull part 11 simultaneously tightens the tightening means 4 for the instep opening 3A and the tightening means 4 for the upper opening 3B, and also simultaneously restrains the movement of the front opening 14 of the inner body B so as to bring together and tighten the left and right edges. Operating the pull part 11 so as to pull merely one end of the shoelace 6 can tighten just the tightening means 4 for the instep opening 3A, and operating the pull part 11 so as to pull merely the other end of the shoelace 6 can tighten just the tightening means 4 for the upper opening 3B.

In the present example, holding- and releasing-enabled tightened-state-holding means 12 for holding the pull part 11 in a pulled state to hold the instep opening 3A, the upper opening 3B, and the front opening 14 of the inner body B in a tightened state is provided midway on the medial portion of the shoelace 6 arranged above the shoelace guide part 18.

Specifically, a conventional lace fastener 21 may be employed for the tightened-state-holding means 12.

A brief description of the lace fastener 21 shall now be provided. A press-contact body 20 for applying pressure to the shoelace 6 inserted through an insertion portion through which the shoelace 6 is inserted is provided in a lace fastener body 19 (i.e., an insertion portion). The press-contact body 20 is provided so as to be capable of sliding against the lace fastener body 19, and offers a simple operation whereby sliding the press-contact body 20 switches between a state in which the shoelace 6 is fastened under pressure applied by the press-contact body 20 and a state in which the applied pressure is released.

The structure whereby the lace fastener 21 tightens and holds the tightening means 4 and the front opening 14 of the inner body B is described as follows. Once the pull part 11 has been pulled and the tightening operation completed, the lace fastener body 19 is caused to slide downward along the shoelace 6 while in the released state. It strikes the upper end of the double pipe 26 of the shoelace guide part 18, and switches to the pressure-applied state, whereupon the pulled shoelace 6 is prevented from returning and is held in a tightened state.

Figure 6:
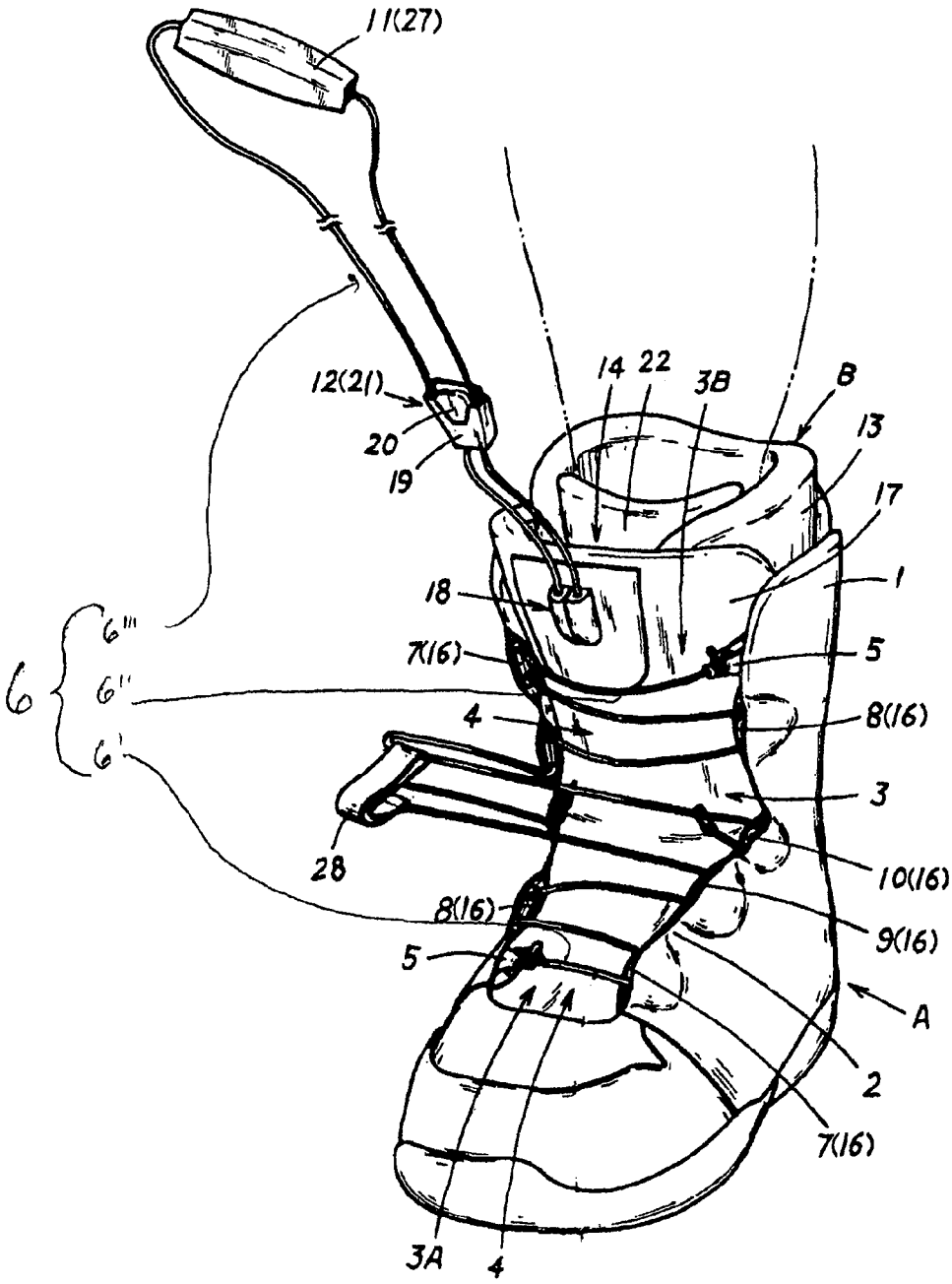
FIG. 6 is a perspective view showing the footwear of Example 1 with the shoelaces loosened.

When this tightening-retention state is to be released, the lace fastener 21 may merely be placed in the released state; however, in the present example, a loosening band 28 is wrapped in an annular configuration around the middle portions of the shoelaces 6 present between the third lace support parts 9 and the fourth lace supports 10 of the tightening means 4, and pulling the loosening band 28 forward of the footwear body A can quickly loosen the tightening means 4 and the front opening 14 of the inner body B (see FIG. 6).

Although the present example shows an instance in which a single long shoelace 6 constitutes the tightening means 4 for the instep opening 3A and the upper opening 3B, the shoelace 6 may be configured by joining a plurality of laces. For example, separate laces (shoelaces 6) may be threaded through the tightening means 4 for the instep opening 3A and the tightening means 4 for the upper opening 3B, the pulling ends of the laces of these tightening means 4 are joined, and the joined part forms the pull part 11, which is the medial portion of the shoelace 6.

The tightened-state-holding means 12 (lace fastener 21) and the shoelace guide part 18 (double pipe 26) may also be used in a combined configuration.

Example 2

A specific Example 2 of the present invention is described below with reference to FIG. 7.

The present example omits the fastening configuration of the inner body B in Example 1.

Specifically, the medial portion 6''' of the shoelace 6 is arranged on the front of the tongue member 17 without passing through to the back of the tongue member 17.

More specifically, the shoelace guide part 18 of the present example is configured by fitting a double pipe 26A passing through vertically on an upper central portion of the front surface part of the tongue member 17.

The medial portion 6''' of the shoelace 6 arranged on the front of the tongue member 17 is passed between the shoelace 6 of the tightening means 4 for the upper opening 3B and the front of the tongue member 17 and inserted into the double pipe 26A from below to above. A pull part 6P of the medial portion 6''' of the shoelace 6 is configured to be pulled from above the double pipe 26A, with or without the pull part 11, 27. In the present example as well, the tightened-state-holding means 12 (the lace fastener 21) and the shoelace guide part 18 (the double pipe 26A) may also be used in a combined configuration.

The rest of the configuration is the same as the example described earlier.

The present invention is not limited to these Examples 1 and 2; specific configurations of the various components may be suitably designed.

The invention claimed is:

1. Footwear comprising:

a footwear body and an inner body inserted into the footwear body;

the footwear body having an upper covering part higher than an ankle portion and having a front opening that opens from the upper covering part to an instep part, the footwear body provided with separate tightening means for each of an instep opening and an upper opening of the front opening wherein a tongue member is arranged in said front opening;

through holes are formed in the tongue member going through the tongue member from back to front;

the inner body having an upper covering part higher than an ankle portion and a front opening in at least the upper covering part;

inner lining eyelets respectively provided on left and right edges of said front opening of said inner body;

the tightening means for the instep opening including a first end of a shoelace comprising a single lace or a plurality of connected laces threaded through a first inner lining eyelet provided on one of the left and right edges of said front opening of the inner body and threaded between left to right sides in a staggered state through said instep opening of said footwear body;

the tightening means for the upper opening including a second end of said shoelace threaded through a second inner lining eyelet provided on another of either the left or right edge of the front opening of the inner body, and the second end of the shoelace threaded between left to right sides in a staggered state through said upper opening of said footwear body;

a medial portion of the shoelace, the medial portion of said shoelace is designed, when assembled, to be threaded through said through holes in the tongue member from front to back; said medial portion being present between the first inner lining eyelet and the second inner lining eyelet and serving as a pull part, configured to be pulled to enable one or both of the tightening means for the instep opening of said footwear body and the tightening means for the upper opening of said footwear body to be tightened;

a shoelace guide part for upwardly guiding the medial portion of the shoelace threaded through to the back of said tongue is provided above said tongue member; and a lace fastener is provided on the medial portion of the shoelace guided upward via the shoelace guide part, the lace fastener is configured to hold the pull part in a pulled state, and to hold the front opening of the inner body in a tightened state, and hold either one or both of the instep opening and the upper opening of said footwear body in a tightened state.

2. The footwear according to claim 1, wherein:

said tightening means for the instep opening comprises:

a first lace-anchoring part provided on one of either the left or right edge of said instep opening, and the first end of said shoelace is anchored to the first lace-anchoring part;

a first lace support part provided on another of either the left or right edge of the instep opening, and for supporting and causing a doubling-back of the medial portion of the shoelace anchored to the first lace-anchoring part; and a second lace support part provided on the one of either the left or right edge of said instep opening and for supporting the medial portion of the shoelace supported and caused to double back by the first lace support part so that the medial portion of the shoelace does not cross a part of the shoelace present between said first lace-anchoring part and said first lace support part, the second lace support part; and wherein pulling the medial portion of the shoelace supported by the second lace support part enables the instep opening to be tightened;

said tightening means for the upper opening comprises:

a second lace-anchoring part provided on one of either the left or right edge of said upper opening, and the second end of said shoelace is anchored to the second lace-anchoring part;

a third lace support part for supporting and causing a doubling-back of the medial portion of the shoelace anchored to the second lace-anchoring part provided on another of either the left or right edge of the upper opening; and a fourth lace support part for supporting the medial portion of the shoelace supported and caused to double back by the third lace support par so that the medial portion of the shoelace does not cross a part of the shoelace present between said second lace-anchoring part and said third lace support part, the fourth lace support part provided on the one of either the left or right edge of said upper opening, wherein pulling the medial portion of the shoelace supported by the fourth lace support part enables the upper opening to be tightened.

3. The footwear according to claim 2, wherein said first lace-anchoring part and said first lace support part are provided substantially horizontal and opposite to each other on the one and the another of the left and right edge of said instep opening;

said second lace support part is provided in a higher position than said first lace-anchoring part in the either one of the left or the right edge of the instep opening;

the medial portion of said shoelace supported and caused to double back by first lace support part is supported by the second lace support part so as not to cross the portion of the shoelace present between said first lace-anchoring part and said first lace support part;

second lace-anchoring part and said third lace support part are provided substantially horizontal and opposite to each other on the one and the other of the light and right edge of said upper opening;

said fourth lace support part is provided in a lower position than said second lace-anchoring part in the either one of the left or the right edge of the upper opening; and the medial portion of said shoelace supported and caused to double back by the third lace support part is supported by the fourth lace support part so as not to cross the portion of the shoelace present between said second lace-anchoring part and said third lace support part.

4. The footwear according to claim 2, wherein each of said first lace support part, said second lace support part, said third lace support part, and said fourth lace support part includes a pulley, respectively.

5. The footwear according to claim 3, wherein each of said first lace support part, said second lace support part, said third lace support part, and said fourth lace support part includes a pulley, respectively.

6. The footwear according to claim 2, wherein said second lace support part for supporting and causing a doubling-back of the medial portion of said shoelace supported and caused to double back by said first lace support part is provided on a same one of either the left or right edge of said instep opening as said first lace anchoring part;

a fifth lace support part for supporting the medial portion of the shoelace supported and caused to double back by the second lace support part, the medial portion of the shoelace supported so as not to cross the portion of the shoelace present between said first lace support part and said second lace support part, is provided on a same the another of either the left or right edge of the instep opening as said first lace support part;

said tightening means of said instep opening is provided so that by pulling the medial portion of the shoelace supported by the fifth lace support parts, the instep opening is tightened;

said fourth lace support part for supporting and causing a doubling-back of the medial portion of said shoelace supported and caused to double back by said third lace support part Is provided on a same one of either the left or right edge of said upper opening as said second lace anchoring part;

a sixth lace support part for supporting the medial portion of the shoelace supported and caused to double back by the fourth lace support part, the medial portion of the shoelace supported so as not to cross the portion of the shoelace present between said third lace support part and said fourth lace support part, is provided on a same the another of either the left or right edge of the upper opening as said third lace support part; and said tightening means of said upper opening is provided so that by pulling the medial portion of the shoelace supported by the sixth lace support parts, the upper opening is tightened.

7. The footwear according to claim 3, wherein said second lace support part for supporting and causing a doubling-back of the medial portion of said shoelace supported and caused to double back by said first lace support part is provided on a same one of either the left or right edge of said instep opening as said first lace anchoring part;

a fifth lace support part for supporting the medial portion of the shoelace supported and caused to double back by the second lace support part, the medial portion of the shoelace supported so as not to cross the portion of the shoelace present between said first lace support part and said second lace support part, is provided on a same the another of either the left or right edge of the instep opening as said first lace support part;

said tightening means of said instep opening is provided so that by pulling the medial portion of the shoelace supported by the fifth lace support part, the instep opening is tightened;

said fourth lace support part for supporting and causing a doubling-back of the medial portion of shoelace supported and caused to double back by said third lace support part is provided on a same one of either the left or right edge of said upper opening as said second lace anchoring part;

a sixth lace support part for supporting the medial portion of the shoelace supported and caused to double back by the second lace support part, the medial portion of the shoelace supported so as not to cross the portion of the shoelace present between said third lace support part and fourth lace support part, is provided on a same the another of either the left or right edge of the upper opening as said third lace support part; and said tightening means of said upper opening is provided so that by pulling the medial portion of the shoelace supported by the sixth lace support parts, the upper opening is tightened.

8. The footwear according to claim 4, wherein said second lace support part for supporting and causing a doubling-back of the medial portion of said shoelace supported and caused to double back by said first lace support part is provided on a same one of either the left or right edge of said instep opening as said first lace anchoring part;

a fifth lace support part for supporting the medial portion of the shoelace supported and caused to double back by the second lace support part, the medial portion of the shoelace supported so as not to cross the portion of the shoelace present between each of said first lace support part and said second lace support part, is provided on a same the another of either the left or right edge of the instep opening as said first lace support part;

said tightening means of said instep opening is provided so that by pulling the medial portion of the shoelace supported by the fifth lace support part, the instep opening is tightened;

said fourth lace support part for supporting and causing a doubling-back of the medial portion of said shoelace supported and caused to double back by said third lace support part is provided on a same one of either the left or right edge of said upper opening as said second lace anchoring part;

a sixth lace support part for supporting the medial portion of the shoelace supported and caused to double back by the fourth lace support part, the medial portion of the shoelace supported so as not to cross the portion of the shoelace present between said third lace support part and fourth lace support part, is provided on a same the another of either the left or right edge of the upper opening as said third lace support part; and said tightening means of said upper opening is provided so that by pulling the medial portions of the shoelace supported by the sixth lace support parts, the upper opening is tightened.

9. The footwear according to claim 5, wherein said second lace support part for supporting and causing a doubling-back of the medial portion of said shoelace supported and caused to double back by said first lace support part is provided on a same one of either the left or right edge of said instep opening as said first lace anchoring part;

a fifth lace support part for supporting the medial portion of the shoelace supported and caused to double back by the second lace support part, the medial portion of the shoelace supported so as not to cross the portion of the shoelace present between said first lace support part and said second lace support part, is provided on a same the another of either the left or right edge of the instep opening as said first lace support part;

said tightening means of said instep opening is provided so that by pulling the medial portion of the shoelace supported by the fifth lace support part, the instep opening is tightened;

said fourth lace support part for supporting and causing a doubling-back of the medial portion of said shoelace supported and caused to double back by said third lace support part is provided on a same one of either the left or right edge of said upper opening as said second lace anchoring part;

a sixth lace support part for supporting the medial portion of the shoelace supported and caused to double back by the second lace support part, the medial portion of the shoelace supported so as not to cross the portion of the shoelace present between said third lace support part and fourth lace support part, is provided on a same the another of either the left or right edge of the upper opening as said third lace support part; and said tightening means of said upper opening is provided so that by pulling the medial portions of the shoelace supported by the sixth lace support parts, the upper opening can be tightened.

10. The footwear according to claim 1, wherein the lace fastener includes an insertion portion and a releaseable press-contact body for making contact under pressure with the shoelace inserted through the insertion portion.

* * * * *

UNITED STATES PATENT AND TRADEMARK OFFICE

CERTIFICATE OF CORRECTION

PATENT NO. : 8,806,778 B2
APPLICATION NO. : 13/963486
DATED : August 19, 2014
INVENTOR(S) : Etsuo Kishino It is certified that error appears in the above-identified patent and that said Letters Patent is hereby corrected as shown below:

In the Specification:

- In column 2, line 20, please insert --6-- after “shoelace”.
- In column 8, line 2, please delete “6”” (second occurrence) and insert --6"--.
- In column 10, line 66, please insert --10-- after “9,”.

In the Claims:

- In column 14, line 52, in claim 1, please insert --said-- before “second”.
- In column 15, line 63, in claim 7, please insert --said-- before “shoelace”.

Signed and Sealed this
Twenty-third Day of February, 2016

Michelle K. Lee

Michelle K. Lee
*Director of the United States Patent and Trademark Office*